United States Patent [19]

Katayama

[11] Patent Number: 4,628,707

[45] Date of Patent: Dec. 16, 1986

[54] AIR CONDITIONER

[75] Inventor: Kaneo Katayama, Yaizu, Japan

[73] Assignee: Mitsubishi Denki Kabushiki Kaisha, Tokyo, Japan

[21] Appl. No.: 798,392

[22] Filed: Nov. 15, 1985

[30] Foreign Application Priority Data

Nov. 27, 1984 [JP] Japan .....59-179619[U]

[51] Int. Cl.[4] ..... F25B 47/00

[52] U.S. Cl. ..... 62/280; 62/281; 62/305

[58] Field of Search ..... 62/279, 280, 281, 304, 62/305, 272

[56] References Cited

U.S. PATENT DOCUMENTS 4,212,172 7/1980 Manno ..... 62/279 X

*Primary Examiner*—Henry Bennett

*Attorney, Agent, or Firm*—Oblon, Fisher, Spivak, McClelland & Maier

[57] ABSTRACT

An air conditioner is provided with a number of linear ribs extended radially from a central member provided in an air outlet port and a number of annular ribs coaxially arranged around the central members in which a passage is formed in the central member so as to pass through it; a drain-water recovering dam member is formed below the passage; some linear ribs extending in the substantially upward and downward directions are projected from the coaxially arranged annular ribs; and some linear ribs extending in the substantially right and left directions are recessed from the coaxially arranged annular ribs, whereby drain water drops spattered by a wind pressure of an air-blowing fan is collected in the drain-water recovering dam member.

7 Claims, 5 Drawing Figures

AIR CONDITIONER

The present invention relates to an air conditioner useful for a so-called window type air conditioning apparatus.

As an air conditioning apparatus there has sidely been used, a window type air one in which the casing body of the air conditioner is attached to a window formed in a wall so as to expose the casing body at both the room interior and exterior sides.

An example of a conventional air conditioner of this kind is disclosed in Japanese Utility Model Application No. 148691/1983 (Japanese Unexamined Utility Model Publication No. 55924/1985 Published on Apr. 19, 1985). The conventional air conditioner will be described with reference to FIG. 5.

A casing 3 of an air conditioner 2 is formed in a shape of a box in a rectangular prism. The casing 3 is mounted in an opening formed in a wall 1 so that a substantially half of the entire length is exposed at the outdoor side. A cooling device 4 and an air-blowing fan for feeding air in a room 5 are provided in a room side section in the casing 3. A condenser 6 formed in a V-shape and an air-blowing fan 8 for feeding air to the outdoor, the fan 8 being directly connected to a motor 7, are provided in an outdoor side section of the casing 3. A compressor 9 is interposed between the cooling device 4 and the condenser 6 to be connected therewith by piping. The cooling device 4 is connected to the condenser 6 by piping. A reference numeral 10 designates a drain pan, a numeral 11 designates an air outlet port and a numeral 12 designates an air discharging nozzle.

In the air conditioner having the above-mentioned construction, when motors used for the fans 5, 8 and the compressor 9 are started, a refrigerant is caused to circulate in a piping system by the compressor 9 and is repeatedly subjected to evaporation and condensation. On the other hand, air in a room is sucked from an intake port formed in a side surface of the casing 3 by the air-blowing fan 5 provided in the room side section. The air is cooled by the cooling device 4 and is blown in the room through the air outlet port 11. Air in the outdoor sucked from an air intake port formed in a side surface of the casing 3 by means of the air-blowing fan 8 provided in the outdoor side section is passed through the condenser 6, where the air is heated by taking heat from the refrigerant gas. Then, the air is discharged to the exterior of the room through the discharging nozzle 12.

In the cooling cycle as above-mentioned, water drops are produced while the air is cooled by the cooling device 4, and the water drops are collected in the drain pan 10. The drain water is spattered by the air-blowing fan 8 to be used for emitting heat in the condenser 6.

In the conventional air conditioner, however, drain water drops are spattered through a latticed cover placed in the front of the discharging nozzle 12 into the room by a wind pressure imparted by the air-blowing fan 8 whereby furnitures around the casing get wet. Further, the collected drain water has merely been discarded.

It is an object of the present invention to provide an air conditioner capable of quickly recovering drain water spattered by a wind pressure of an air-blowing fan by utilizing an air outlet port so that the drain water can be utilized for emitting heat of a condenser and preventing furnitures placed around the casing from getting.

The foregoing and the other objects of the present invention have been attained by providing an air conditioner comprising a box-like casing having an air-blowing outlet in its one side surface and an air-blowing fan facing the air-blowing outlet in the casing, the air-blowing fan being provided with a water-spattering ring for spattering drain water to a condenser, characterized by comprising a cetral member placed in the air-blowing outlet, a number of annular ribs coaxially arranged around the central member, a number of linear ribs radially extended from the central member so as to intersect the annular ribs, a passage for drain water which is formed in the central member to communicate the front side with the rear side, and a drain-water recovering dam member which is formed below the passage for drain water to feed drain water into the interior of the casing, wherein some linear ribs exteding in the substantially upward and downward directions among the radially extended linear ribs project from levels of the coaxially arranged annular ribs, and some linear ribs extending in the substantially right and left directions are recessed from levels of the coaxially arranged annular ribs.

Figure 1:
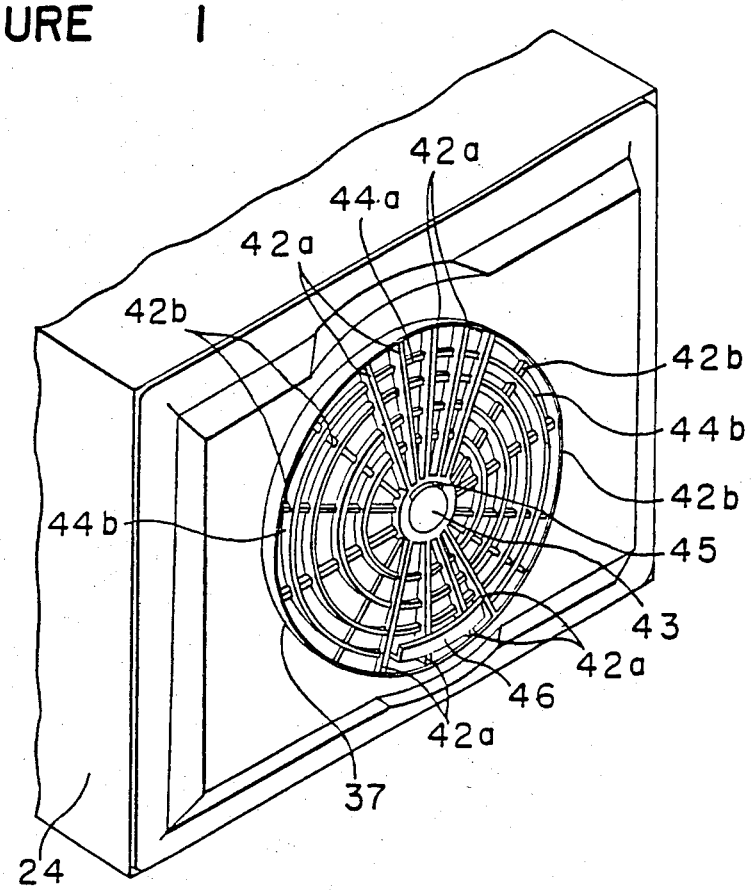
FIG. 1 is a perspective view showing an important part of an embodiment of the air conditioner according to the present invention.
Figure 2:
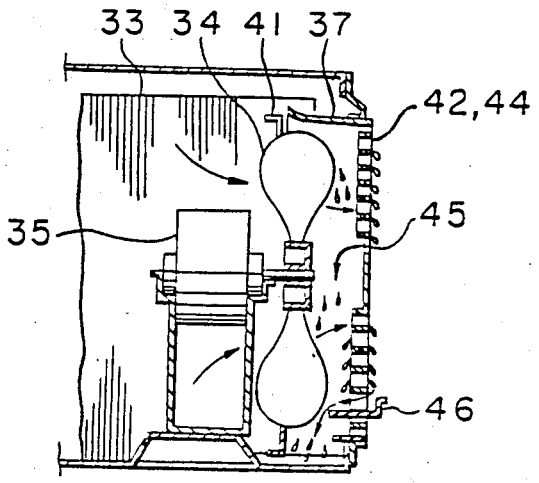
FIG. 2 is a cross-sectional view of an important part of an embodiment of the air conditioner according to the present invention.
Figure 3:
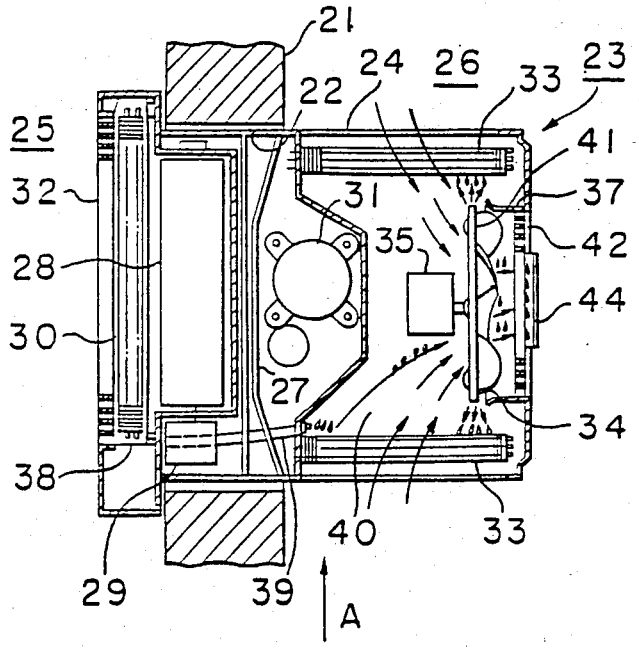
FIG. 3 is a plan view showing the interior of an embodiment of a casing of the air conditioner according to the present invention.
Figure 4:
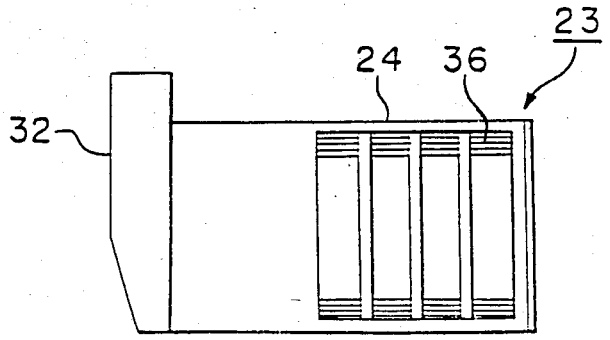
FIG. 4 is a side view in view of an arrow mark A in FIG. 3.
Figure 5:
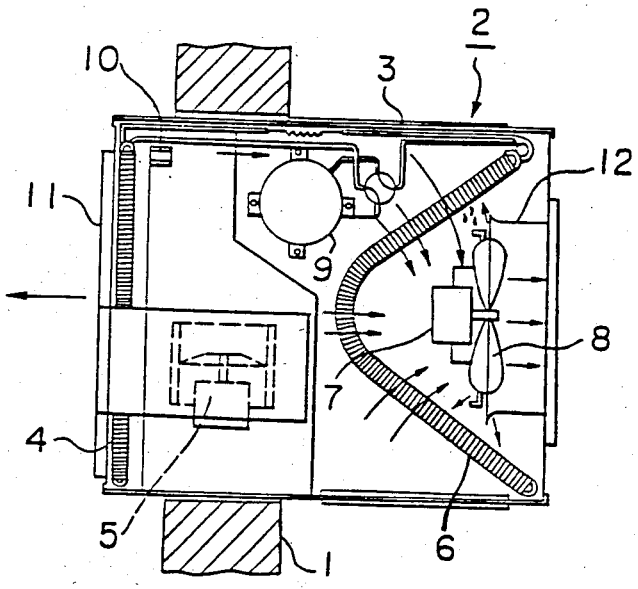

And FIG. 5 is a plan view showing the interior of a casing of a conventional air conditioner.

An embodiment of the present invention will be described with reference to drawing.

In FIGS. 1 to 4, a rectangular box-like casing 24 of an air conditioner, designated as a whole by a reference numeral 23, is inserted in an opening 22 formed in a wall 21 of a building, from the side of a room 25 and is firmly secured to the wall 21. An outdoor side section of the casing 24 having a length substantially one half of the entire length of the casing is exposed to the outdoor 26. A part of a room side section which is separated by a partition plate 27 which separates the room side section from the outdoor side section is exposed to the room 25. An air-blowing fan 28 is placed in the room side section in the casing 24 to supply air to the room. The air-blowing fan 28 is directly connected to a motor 29 to be driven.

A cooling device 30 having a number of fins is held at the exposed portion of the room side section of the casing 24. A compressor 31 is disposed in the central portion of the casing 24. The cooling device 30 is connected to the air intake side of the compressor 31 by a pipe (not shown). An air outlet port 32 provided with a number of ribs is formed at the front end of the casing 24 facing the room 25 to supply air into the room 25, the air being cooled while it is sucked from the room 25 by means of the air-blowing fan 28 to be passed through the cooling device 30.

On the other hand, condensers 33 are provided in the vicinity of the inner walls at both sides of the outdoor side section of the casing 24, each of the condensers 33 being formed by stacking a plurality of condenser elements having a number of fins. The condensers 33 are connected to the discharge side of the compressor 31 by pipes (not shown). The condensers 33 are also connected to the cooling device 30 by separate pipes. An air-blowing fan 34 for suppling air to the outdoor is arranged at the middle portion between the condensers 33 to perform such function such that the air-blowing fan 34 is driven by a motor 35 having a direct connection with the same to thereby suck air from the outdoor through an air intake port 36 formed in a side wall of the casing 24. The sucked air cooled the condensers 33, and thereafter, it is discharged through a cylindrical air-blowing outlet 37 formed at the rear end of the casing 24.

A refrigerant gas is filled in a piping system in the casing to be compressed by the compressor 31. The refrigerant gas is repeatedly subjected to evaporation by the cooling device 30 and condensation by the condensers 33. A drain pan 38 is provided below the cooling device 30 to store drain water produced when a room air directed to the air outlet port 32 by the air-blowing fan 28 is cooled at the cooling device 30. A drain pipe 39 connected to the drain pan 38 openes on the base plate 40 in the outdoor side section which is lower than the drain pan, namely, the below of the air-blowing fan 34, whereby the drain water is discharged on the base plate 40. The air-blowing fan 34 used for suppling air to the outdoor side is provided with a water-spattering ring 41 which is formed integrally with blades. The construction of the water-spattering ring 41 is such that when it is rotated, drain water on the base plate 40 is splashed to the condensers 33 to cool the same. In the air-blowing outlet 37, there are provided a number of linear ribs 42 which extends radially from a central area for attaching a trademark as a central member 43, each other end of the linear ribs 42 being connected to the inner circumference of the air outlet 37. A number of annular ribs 44 are coaxially arranged in the air-blowing outlet 37 around the central memeber 43 and intersect the linear ribs 42. A relation of the annular ribs 44 to the linear ribs 42 is such that some linear ribs **42*a* extending in the substantially upward and downward directions among the radially extending linear ribs 42 have dimensions higher than the dimensions of the coaxially arranged annular ribs 44*a*, i.e. the linear ribs 42*a* project from levels of the annular ribs 44*a*, and some linear ribs 42*b* extending in the substantially right and left directions have dimensions lower than those of the annular ribs 44*b*. Further, the linear ribs 42*a* have the same hight as the annular ribs 44*b*, and the linear ribs 42*b* have the same hight with the annular rib 44*a*. This construction enables that drain water drops deposited on the annular ribs 44*a* in the upper and lower parts of the air-blowing outlet 37 with respect to the central member 43 are led to the linear ribs 42*a* in the vicinity of the annular ribs 44*a*; drain water drops deposited on the linear ribs 42*b* in the right and left parts with respect to the central member 43 are led to the annular ribs 44*b* in the vicinity of the linear ribs 42*b*, whereby the drain water drops carried by a wind pressure of the air-blowing fan 34 and deposited on the both groups of the ribs 42, 44 are quickly fed to the lower part of the air-blowing outlet 37 due to the gravity. A passage 45 for recovering the drain water is formed at the upper circumference of the central member 43 to communicate the outside of the casing 24 with the inside of the casing 24. In other words, the passage 45 is formed in the central member 43 to have its inlet opening at a position where some linear ribs 42*a* extending upwardly among a number of the radially extended linear ribs 42 are connected to the central member 43. A reference numeral 46 designates a drain-water recovering dam member for introducing drain water drops deposited on the ribs 42, 44 to the inside of the casing 24. The drain-water recovering dam member 46 is provided so as to traverse some linear ribs 42*a* extending downwardly from the central member 43 having the passage 45. An upright piece is formed at an end on the outdoor side of the dam member 46** to prevent discharging of drain water.

The operation of the air conditioner having the construction as above-mentioned will be described.

On actuating the motors 29, 35 and the compressor 31, the refrigerant gas to be circulated in the piping system is compressed for cooling by the compressor 31, and evaporation of the refrigerant by the cooling device 30 and condensation by the condensers 33 are repeated. Air in the room 25 is sucked by the air-blowing fan 28 to be blown to the cooling device 30. The air cooled by the cooing device 30 is blown to the room 25 through the air outlet port 32.

On the other hand, air in the outdoor 26 is sucked from the air intake port 36 by the operation of the air-blowing fan 34 and is blown through the air-blowing outlet 37. While the air is passed in the casing 24, it cools the condensers 33.

In the cooling cycle as described above, air blown to the cooling device 30 by the air-blowing fan 28 is cooled by the cooling device 30 and water drops are produced by condensation. The drain water is collected in the drain pan 38 and is discharged to the table base 40 through the drain pipe 39. The discharged drain water is splashed to the condensers 33 by the water-spattering ring 41 rotated together with blades of the air-blowing fan 34 whereby the condensers 33 are cooled. A part of the drain water is flown by a wind pressure of the air-blowing fan 34 to deposite on the linear ribs 42 and annular ribs 44 at the air-blowing outlet 37. In this case, drain water drops deposited on the annular ribs **44*a* which are located at the upper part of the air-blowing outlet 37 are introduced to the linear ribs 42*a* in the vicinity of the annular ribs 44*a*, whereby the drain water drops are joined with the water drops falling on the linear ribs 42*a*. Then, the drain water drops flow in the passage 45 formed in the central member 43 to be flown to the reverse side of the central member 43 and are transmitted to the linear ribs 42*a* extending downwardly from the central member 43. And thereafter, the drain water drops are collected into the drain-water recovering dam member 46 to be supplied on the table base 40 in the casing 24**.

On the other hand, drain water drops deposited on the linear ribs **42*b* extending in the substantially right and left directions from the central member 43 are guided to the annular ribs 44*b* in the vicinity of the linear ribs 42*b*, whereby they are joined with the drain water drops flowing along the annular ribs 44*b*. The water drops are transmitted to the linear ribs 42*a* extending downwardly in the air-blowing outlet 37 and recovered on the base plate 40 after having been passed through the drain-water recovering dam member 46. The drain water thus recovered can be repeatedly used for cooling the condensers 33**.

Thus, in accordance with the air conditioner of the present invention, drain water drops splashed by a wind pressure of the air-blowing fan are quickly collected at the air-blowing outlet and are recovered in the casing. Accordingly, drain water can be resued for emitting heat in the condensers. Further, the present invention has an additional advantage that furnitures positioned around the air conditioner are prevented from getting wet by the drain water.

I claim:

1. An air conditioner comprising a box-like casing having an air-blowig outlet in its one side surface and an air-blowing fan facing said air-blowing outlet in said casing, said air-blowing fan being provided with a water-spattering ring for spattering drain water to a condenser, characterized by comprising a central member placed in said air-blowing outlet, a number of annular ribs coaxially arranged around said central member, a number of linear ribs radially extended from said central member so as to intersect said annular ribs, a passage for drain water which is formed in said central member to communicate the front side with the rear side, and a drain-water recovering dam member which is formed below said passage for drain water to feed drain water into the interior of said casing, wherein some linear ribs extending in the substantially upward and downward directions among said radially extended linear ribs project from levels of said coaxially arranged annular ribs, and some linear ribs extending in the substantially right and left directions are recessed from levels of said coaxially arranged annular ribs.

2. An air conditioner according to claim 1, wherein said passage is formed in said central member to have its inlet opening at a position where some linear ribs extending upwardly among said radially extended linear ribs are connected to said central member.

3. An air conditioner according to claim 1, wherein said drain-water recovering dam member is provided so as to traverse some linear ribs extending downwardly from said central member among said radially extended linear ribs, and an upright piece is formed at an end on the outdoor side of said dam member to prevent discharging of drain water.

4. An air conditioner according to claim 1, wherein some linear ribs extending in the substantially upward and downward directions among said radially extended linear ribs have surfaces facing the outdoor side which project from the surfaces facing the outdoor side of said coaxially arranged annular ribs intersecting with said linear ribs, whereby water drops on said annular ribs are downwardly fed by means of said linear ribs.

5. An air conditioner according to claim 1, wherein some linear ribs extending in the substantially right and left directions among said radially extended linear ribs have surfaces facing the outdoor side which are recessed from surfaces facing the outdoor side of said coaxially arranged annular ribs intersecting said linear ribs, whereby water drops on said linear ribs are downwardly fed by said annular ribs.

6. An air conditioner according to claim 5, wherein said coaxially arranged annular ribs are crossed to linear ribs extending downwardly from said central member so that water drops fed by said annular ribs are guided by said linear ribs to enter into said dam member.

7. An air conditioner according to claim 1, wherein said radially extended linear ribs intersect said coaxially arranged annular ribs in such a manner that some linear ribs extending in the substantially upward and downward directions project from said annular ribs in the downstream direction of wind supplied from said air-blowing fan, and some linear ribs extending in the substantially right and left directions are recessed from said annular ribs in the downstream direction of the wind.

* * * * *